US007503716B2

(12) United States Patent
Herrmann et al.

(10) Patent No.: US 7,503,716 B2
(45) Date of Patent: Mar. 17, 2009

(54) WRITING INSTRUMENT WITH ROLL-PREVENTING ERASER

(76) Inventors: Shelley Herrmann, 407 Castle Ave., Mt. Orab, OH (US) 45154; Nancy Hall, 124 Emmons Pl., Mt. Orab, OH (US) 45154

( * ) Notice: Subject to any disclaimer, the term of this patent is extended or adjusted under 35 U.S.C. 154(b) by 0 days.

(21) Appl. No.: 11/773,087

(22) Filed: Jul. 3, 2007

(65) Prior Publication Data

US 2008/0019759 A1 Jan. 24, 2008

Related U.S. Application Data

(60) Provisional application No. 60/807,847, filed on Jul. 20, 2006.

(51) Int. Cl.
*B43K 25/00* (2006.01)
*B43K 29/02* (2006.01)

(52) U.S. Cl. ..... 401/52; 401/195; 15/427; 15/431; D19/53; D19/58

(58) Field of Classification Search ..... 401/52, 401/195; 15/424, 427, 428, 431; D19/53, D19/58

See application file for complete search history.

(56) References Cited

U.S. PATENT DOCUMENTS

| | | | | | |
|---|---|---|---|---|---|
| 368,159 | A | * | 8/1887 | Mussinan, Jr. | 279/23.1 |
| 833,744 | A | | 10/1906 | Koehler | |
| 1,550,770 | A | | 8/1925 | Akira | |
| 1,998,684 | A | * | 4/1935 | Musgrave | 15/431 |
| 2,161,086 | A | * | 6/1939 | Pipi | 15/431 |
| 2,205,929 | A | * | 6/1940 | Musgrave | 15/431 |
| 2,448,103 | A | * | 8/1948 | Linden | 15/427 |
| 2,496,086 | A | | 1/1950 | Fitzgerald | |
| 3,523,321 | A | | 8/1970 | Francis | |
| 5,555,602 | A | | 9/1996 | Leamond | |
| 6,547,465 | B1 | | 4/2003 | Rago et al. | |
| 6,571,480 | B1 | | 6/2003 | Qiu | |
| 6,732,407 | B2 | | 5/2004 | Weiss | |
| 6,733,402 | B2 | | 5/2004 | Christensen | |

* cited by examiner

*Primary Examiner*—David J Walczak
(74) *Attorney, Agent, or Firm*—Wood, Herron & Evans, LLP

(57) ABSTRACT

A writing instrument includes an elongate body having opposed first and second ends, a longitudinal axis and a bore therein extending from the first end. A marking body, such as one having lead or a colored material, extends from the first end and is seated in the bore, while a connector is coupled to the second end. An eraser, such as a rubber eraser, is coupled to the connector and is configured to erase markings made by the marking body. The eraser includes a flat surface that is configured to prevent the writing instrument from rolling about the axis down an inclined surface contacting the elongate body. The flat surface may be oriented on a plane that is substantially parallel to the axis. The flat surface may also include a dimension perpendicular to the axis that is larger than another dimension of the elongate body which is also perpendicular to the axis.

13 Claims, 4 Drawing Sheets

WRITING INSTRUMENT WITH ROLL-PREVENTING ERASER

CROSS-REFERENCE TO RELATED APPLICATIONS

This application claims priority to provisional patent application Ser. No. 60/807,847 filed on Jul. 20, 2006, the disclosure of which is expressly incorporated by reference herein in its entirety.

FIELD OF THE INVENTION

This invention relates to writing instruments and, more particularly, to writing instruments having erasers at one end thereof.

BACKGROUND OF THE INVENTION

Writing instruments such as graphite or lead pencils are well known and are used for drawing and writing. Lead pencils may have a graphite center for drawing in gray or black on a paper or page. Alternatively, lead pencils may have a colored center for drawing in colors, such as red green or blue, on a paper or other objects. Known lead pencils have an elongated body with a cylindrical or polygonal cross-section which surrounds the graphite or lead center and may further be made out of wood or other suitable material.

A sharp end of known lead pencils includes a tip or point of the graphite or colored center that extends from a conical portion of the body surrounding the graphite or colored lead center. When the tip or point of the lead or colored center breaks or wears out, a user needs to sharpen the lead pencil to remove additional body material, such as wood, surrounding the graphite or colored center, such that a new tip or point of graphite or color appears for writing or drawing. As the tip or point of graphite or color is dragged across an object such as paper, graphite or color material can be left behind on the object, thereby leaving a mark. In some cases, particularly when drawing, it is desirable to remove the graphite or color marks using an eraser.

To address the need to remove the graphite or color marks, some lead pencils include a rubber eraser or the like affixed to a butt end of the pencil, opposite the sharp end thereof. The rubber eraser is rubbed over a mark on the paper or object to thereby remove the mark. As the eraser is rubbed over surfaces of papers or objects, some rubber is worn off, thereby reducing the usable amount of the eraser.

Typically, the size of the rubber eraser that is fixed to the end of the pencil is relatively small in comparison to the length and typical life of the available lead pencil. In some instances, there is a relatively high frequency of use of the rubber eraser on the end of the pencil to erase marks. These two factors, when combined, may result in the eraser being quickly worn out and down to an unusable amount. In such instances, a user is often left with a long pencil with no usable eraser affixed to the end thereof. In other instances, a user may abuse the eraser affixed to the end of the pencil by biting or chewing it to a minimal length, thereby rendering the eraser unusable.

With no usable eraser affixed to the end, a user may choose to avoid using the pencil altogether. Older pencils without usable erasers may be simply thrown away and replaced with new pencils having usable erasers. The net result of this is a relative short life span of known pencils.

Another problem facing known graphite or color pencils is their tendency to roll down an inclined surface. School desks, for example, may be designed with an inclined surface and pencils are placed on top of such surfaces. Likewise, notebook or three-ring binders typically used by school children are designed so that when closed and placed on a flat surface, the surface facing the user is similarly inclined. Pencil users are known to place their pencils on top of these binders. In these two types of instances, known pencils roll down the inclined surface and often fall to the ground, presenting an inconvenience for the user, who is forced to bend over to pick the pencil up. Moreover, the constant disturbance of pencils rolling off of desks and onto the floor may be a distraction for students and teachers alike. Having a pencil on the ground may, in some instances, present a safety hazard, as a person may conceivably step on the pencil, causing him/her to lose his/her balance and fall. Yet another result is that a pencil on the ground may be inadvertently pushed under furniture or away from the user's work station or desk, forcing the user to replace the pencil altogether.

Therefore, a pencil that does not roll down inclined surfaces typically found in a pencil user's environment would be highly desirable. Moreover, a pencil that can be readily sharpened with existing sharpeners but which includes an eraser having a life commensurate with the life of the pencil's lead is similarly desirable. Finally, a pencil that minimizes the incidence of a user's destructive chewing of the eraser is desirable as well.

SUMMARY OF THE INVENTION

In one embodiment, a writing instrument includes an elongate body having opposed first and second ends, a longitudinal axis, and a bore therein extending from the first end. A marking body, such as one having lead or a colored material, extends from the first end and is seated in the bore, while a connector is coupled to the second end. An eraser, such as a rubber eraser, is coupled to the connector and is configured to erase markings made by the marking body. The eraser includes a flat surface that is configured to prevent the writing instrument from rolling about the axis down an inclined surface contacting the elongate body. The flat surface may be oriented on a plane that is substantially parallel to the axis. The flat surface may also include a first dimension perpendicular to the axis that is larger than another dimension of the elongate body which is parallel to the first dimension.

In one aspect of an embodiment, the connector includes metal. In another aspect, the connector may be crimped to the elongate body. In a specific embodiment, the eraser is releasably coupled to the connector.

In another embodiment, a pencil includes a wooden elongate body including opposed first and second ends, a longitudinal axis, and a bore extending between the first and second ends. A lead marking body extends from the first end and is seated in the bore. A metal connector is coupled to the second end. The pencil includes an eraser coupled to the connector and configured to erase markings made by the marking body. In one aspect of this embodiment, the eraser includes a flat surface configured to prevent the pencil from rolling about the axis down an inclined surface contacting the elongate body.

In yet another embodiment, an eraser assembly is adapted for use with a writing instrument having a proximal end and a longitudinal axis. The assembly includes a metal connector having first and second ends. The first end is configured to be coupled to the proximal end of the writing instrument. An eraser is coupled to the second end and is configured to erase markings made by the writing instrument. The eraser includes a flat surface configured to prevent the writing instrument from rolling about the longitudinal axis down an inclined surface contacting the writing instrument.

The metal connector may be releasably coupled to the eraser, which in some embodiments may include rubber. The metal connector may also be configured to be releasably coupled to the writing instrument. In one aspect of some embodiments, the flat surface comprises a width larger than a width or a diameter of the writing instrument.

BRIEF DESCRIPTION OF DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
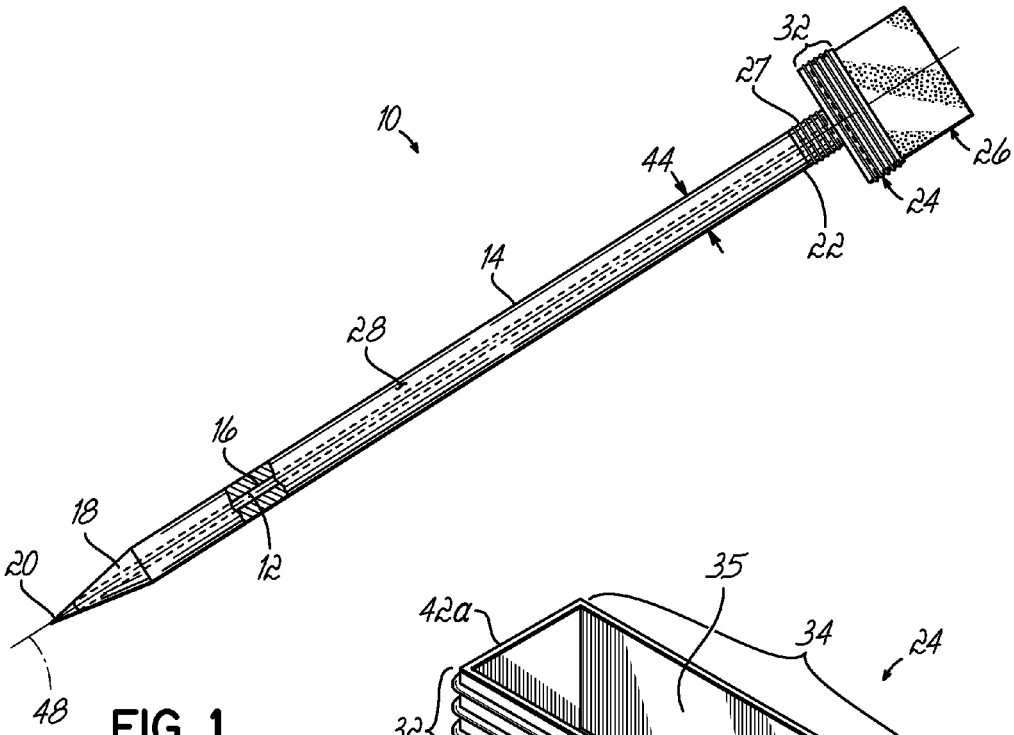
FIG. 1 is an elevational, partial cross-sectional view of one embodiment of the invention, showing the general components of a pencil including a roll-preventing eraser and a connector.

With reference to the figures and, more particularly to FIG. 1, a writing instrument in the form of a wooden lead or graphite pencil 10 includes a hollow interior 12 and an elongated wooden body 14. A cylindrical elongated graphite or lead-marking body 16 extends through the hollow interior 12 of the pencil 10. Other options for the elongated body may include, for example, without limitation, a thermoplastic material suitable for removal and subsequent exposure of the lead-marking body 16. Similarly, while this embodiment shows a graphite pencil 10, it is contemplated that the elongated lead marking body 16 could also be made of other materials, such as those known to leave color marks on paper. Likewise, while the pencil 10 of this exemplary embodiment shows an elongated lead-marking body 16 having a cylindrical cross-section, other cross-sectional shapes can be substituted.

The pencil 10 has a first end 18 exposing a lead tip 20 of the lead marking body 16, which allows the user to write or draw on an object such as paper or other substrate by running the lead tip 20 against a surface of such object. The pencil 10 has a second end 22 that is adapted to receive a ferrule or connector 24, which is in turn adapted to at least partially receive an eraser 26 therein. The connector 24 in this exemplary embodiment is formed from a sheet of metal but it could alternatively be made of any other material suitable to carry out a coupling function between the eraser 26 and the elongated wooden body 14.

With reference to FIGS. 1-4, the connector 24 has a generally cylindrical first portion 27 configured to fit over a portion of the elongated wooden body 14 at the second end 22. In one aspect of this embodiment, the first portion 27 overlaps outer surface 28 of the elongated wooden body 14 by a distance 30 sufficient to firmly hold the connector 24 so as to prevent lateral and longitudinal movement of the connector 24 relative to the elongated wooden body 14. The first portion 27 of the connector 24 of this embodiment can be connected to the elongate wooden body 14 of the pencil 10 by any suitable means such as, and without limitation, crimping, prongs, adhesive bonding, mechanical bonding, mechanical fastening, pressure fitting or any combination thereof. The connector 24 may be made of any suitably chosen materials to allow coupling to the body 14 and eraser 26. For example, and without limitation, the connector 24, as noted above, may be made of a metal. Moreover, the connector 24 may be releasably coupled to the body 14 of the pencil 10.

Figure 2:
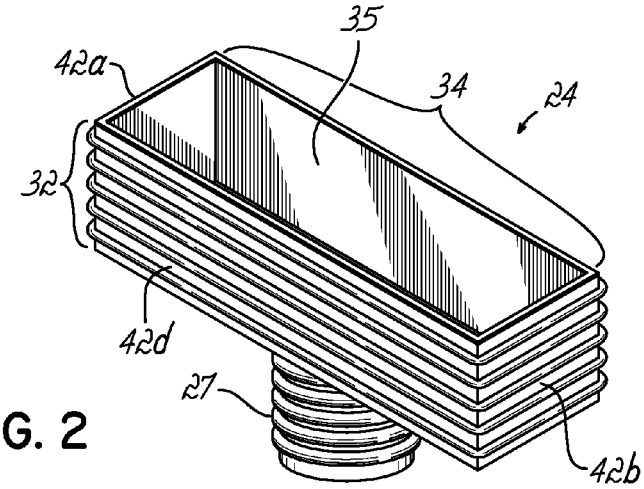
FIG. 2 is a perspective view of the connector of FIG. 1.
Figure 3:
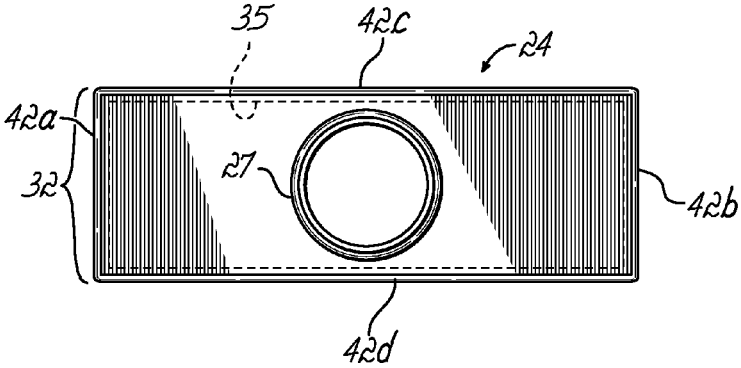
FIG. 3 is a bottom view of the connector of FIG. 2.

With particular reference to FIGS. 2-3, the connector 24 includes a second portion 32 coupled to or integrally formed with the first portion 27 and including an opening 34 that defines a cavity 35 of the connector 24. In one aspect of this embodiment, the second portion 32 has a generally rectangular cross-section when seen from below (FIG. 3). The second portion 32 is configured to receive and hold the eraser 26 therein. More particularly, the second portion 32 receives and couples a proximal portion 29 (FIG. 4) of the eraser 26 that may, for example, be shaped to substantially match the cross-sectional shape of the cavity 35. In this exemplary embodiment, the proximal portion 29 of the eraser 26 has a generally rectangular cross-sectional shape, thereby matching the exemplary rectangular cross-sectional shape of the second portion 32 of the connector 24. The second portion 32 of the connector 24 overlaps the eraser 26 by a distance 38 suitably chosen to engage and prevent the eraser 26 from sliding or generally moving relative to the connector 24.

Figure 4:
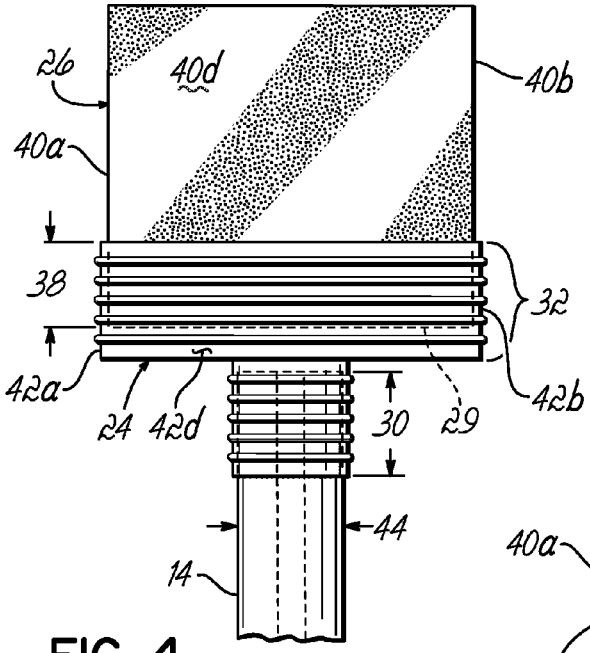
FIG. 4 is an elevational view of the connector and eraser of FIGS. 1-3.
Figure 5:
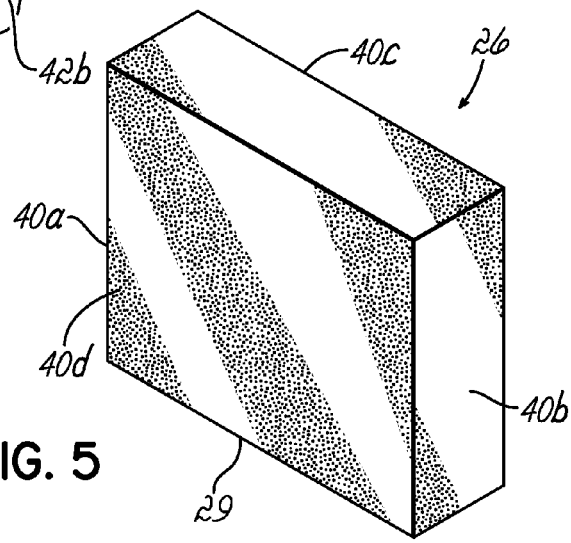
FIG. 5 is a perspective view of the eraser of FIGS. 1 and 4.

With reference to FIGS. 4-5, the second portion 32 of the connector 24 is coupled to one or more sides 40*a*, 40*b*, 40*c*, 4*d* of the eraser 26 by any suitable means involving, for example, and without limitation, adhesive bonding, prongs, mechanical bonding, pressure fitting or any combination thereof. While this embodiment shows coupling of the connector 24 to one or more of the sides 40*a*-40*d* of the eraser 26, persons of ordinary skill in the art will readily appreciate that other surfaces or even an interior portion of the eraser 26 may be chosen to engage and secure the eraser 26 the connector 24. Moreover, the eraser 26 may be releasably coupled to the connector 24, for example, to permit replacement thereof.

Figure 7:
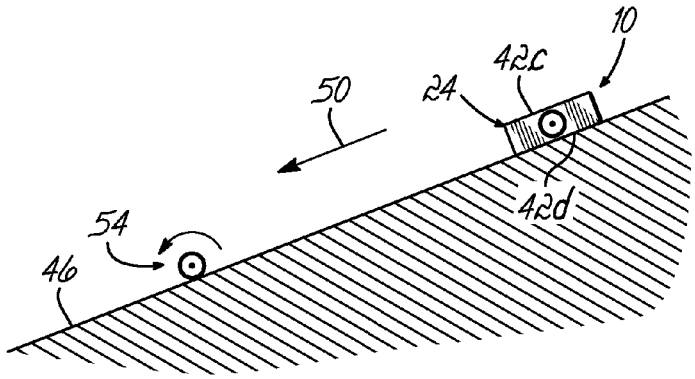
FIG. 7 is an elevational view of an inclined surface, showing the pencil of FIG. 1 at rest and the conventional pencil of FIG. 6 rotating down the inclined surface.
Figure 6:
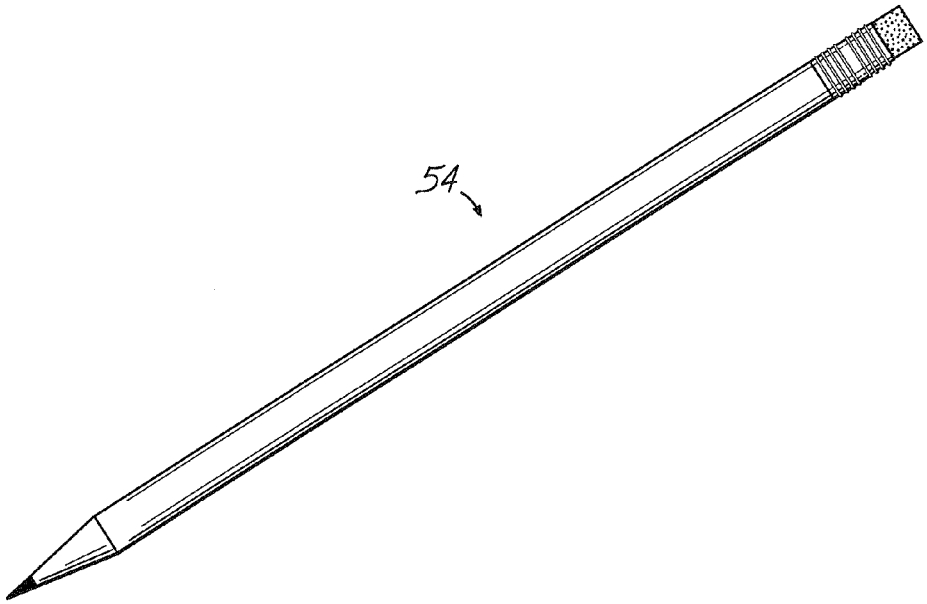
PRIOR ART FIG. 6
FIG. 6 shows a known, conventional pencil of the prior art.

In one aspect of this embodiment, and with further reference to FIGS. 6-7, one or more of four sides 42*a*, 42*b*, 42*c*, 42*d* of the second portion 32 of the connector 24 is generally planar and larger than a width or diameter 44 of the elongated wooden body 14 of the pencil 10. Accordingly, stability of the pencil 10 resting on any surface 46 is enhanced, thereby allowing the pencil 10 to remain on the surface 46 even if the surface 46 is inclined, as the exemplary surface shown in FIG. 7. When the pencil 10 rests, for example, on a flat surface jointly defined by one of the sides 42*c*, 42*d* of the connector 24 and a corresponding, coplanar flat side 40*c*, 40*d* of the eraser 26, the pencil 10 will not be overcome by a tendency of the elongated wooden body 14 to rotate about a longitudinal axis 48 thereof (FIG. 1) in a direction, indicated by arrow 50, corresponding to a direction of incline of the inclined surface 46 when the body 14 is in contact with inclined surface 46.

In another aspect of this embodiment, the inclusion of at least one side 40*a*-40*d* of the eraser 26 being generally planar and longer than the width or diameter 44 of the elongated wooden body 14, results in a relatively large eraser 26 (i.e., an eraser larger than those of conventional pencils). This relatively large size of the eraser 26 prolongs the life of the erasing feature of the pencil 10, and thereby the useful life of the pencil 10. More particularly, the relative large size allows a greater number of erasing events and total number/amount of markings that can be removed therewith. Moreover, the relatively large eraser 26 deters an often-unconscious tendency of users to place erasers of known pencils, such as the prior art pencil 54, in their mouths. This determent is facilitated by the unnatural fit of a relatively large object in a human mouth. In an advantageous aspect, the result of this determent also prevents destruction of the eraser 26 and the pencil 10, further prolonging the useful life of the pencil 10.

With reference to FIGS. 7, 8A-8D, and as noted above, the eraser 26 has a rectangular cross-section. One skilled in the art, however, may choose to make this cross section in one of many different shapes such as, and without limitation, triangular, pentagonal, square or any other shape containing at least one flat surface or side. Similarly, an artisan may choose to make this cross-sectional shape such that there is only one rectilinear segment, such as one approximating, for example, a "D" shape. Examples of alternative embodiments can be appreciated in FIGS. 8A-8D, which depict examples of alternative erasers 56-59. The inclusion of at least one flat side, such as the exemplary surfaces 60-63, allows a pencil having an eraser 56-59 to rest on such side 60-63 without the tendency of the pencil to roll down an inclined plane, such as the inclined surface 46.

The eraser 26 in this embodiment is made out of rubber, however one skilled in the art may choose to substitute other suitable material capable of removing marks made by a writing instrument, such as a pencil, onto which it is connected. Although the pencil 10 of this embodiment is depicted and described as a wooden lead pencil 10, persons of ordinary skill in the art will appreciate that, alternatively, the eraser 26 may be combined with other types of writing instruments.

Figure 9:
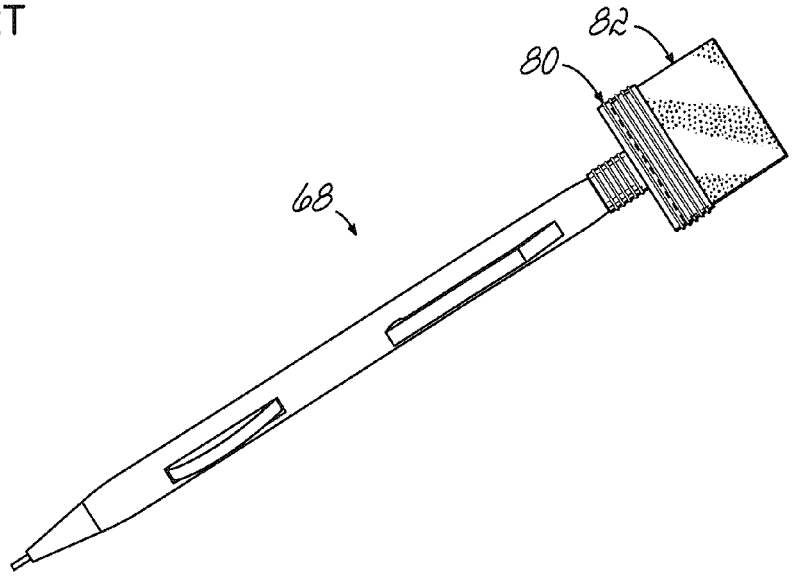
FIG. 9 shows an alternative embodiment of a writing instrument in accordance with the principles of this invention.
Figure 8A:
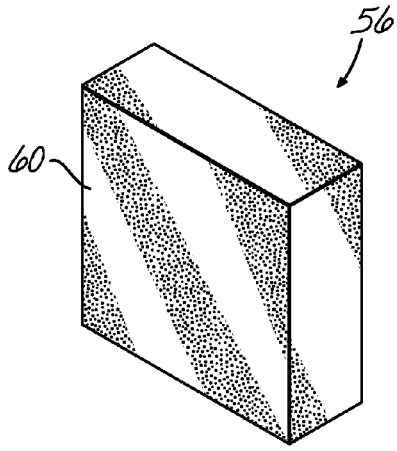
FIGS. 8A-8D show alternate embodiments of erasers in accordance with the principles of this invention.
Figure 8B:
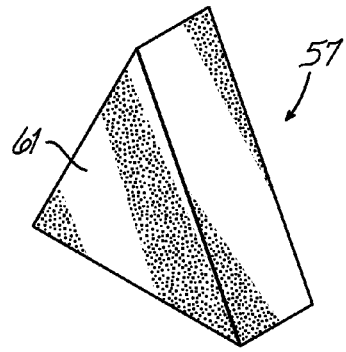
Figure 8C:
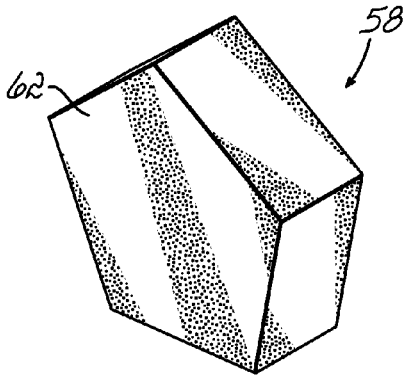
Figure 8D:
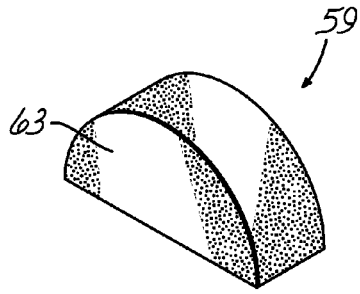

With reference to FIG. 9, an alternative embodiment of a writing instrument in the form of a mechanical pencil 68 may include features similar to those described with regard to the exemplary pencil 10 of FIGS. 1-4. In this regard, therefore, the mechanical pencil 68 includes a connector 80 and an eraser 82 respectively similar, in most respects, to the connector 24 and eraser 26 of pencil 10, the respective descriptions of which may be referred to for an understanding of this embodiment as well. Likewise, although not shown, the principles described with regard to the exemplary pencil 10 are contemplated as similarly applicable to erasable ink pens or any other writing instrument including an eraser at one end thereof and still provide the benefits noted above for the exemplary pencil 10 of FIGS. 1-4.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

What is claimed is:

1. A writing instrument comprising:

an elongate body including opposed first and second ends, a longitudinal axis and a bore therein extending from said first end;

a marking body extending from said first end and seated in said bore;

a connector coupled to said second end; and an eraser coupled to said connector and configured to erase markings made by said marking body, said eraser including a flat surface configured to prevent said writing instrument from rolling about said axis down an inclined surface contacting said elongate body, wherein said eraser includes a first dimension perpendicular to said axis and a second dimension perpendicular to said first dimension and to said axis, said second dimension being greater then said first dimension;

wherein said connector includes first and second connector dimensions substantially respectively equal to said first and second dimensions of said eraser.

2. The writing instrument of claim 1, wherein said marking body further comprises lead.

3. The writing instrument of claim 1, wherein said marking body further comprises a colored material.

4. The writing instrument of claim 1, wherein said connector further comprises metal.

5. The writing instrument of claim 1, wherein said flat surface is oriented on a plane substantially parallel to said axis.

6. The writing instrument of claim 1, wherein said connector is crimped to said elongate body.

7. The writing instrument of claim 1, wherein said eraser further comprises rubber.

8. The writing instrument of claim 1, wherein said eraser is releasably coupled to said connector.

9. A pencil comprising:

a wooden elongate body including opposed first and second ends, a longitudinal axis, and a bore therein extending between said first and second end;

a lead marking body extending from said first end and seated in said bore;

a metal connector coupled to said second end; and an eraser coupled to said connector and configured to erase markings made by said marking body, said eraser including a flat surface configured to prevent said pencil from rolling about said axis down an inclined surface contacting said elongate body, wherein said eraser includes a first dimension perpendicular to said axis and a second dimension perpendicular to said first dimension and to said axis, said second dimension being greater than said first dimension;

wherein said metal connector includes first and second connector dimensions substantially respectively equal to said first and second dimensions of said eraser.

10. The pencil of claim 9, wherein said eraser has a substantially cuboid shape.

11. The writing instrument of claim 1, wherein said eraser has a substantially cuboid shape.

12. The writing instrument of claim 1. wherein said connector has a first portion of generally circular cross-section configuration mounted to said second end of the elongate body and a second portion mounted to said eraser and having a generally rectangular cross-sectional configuration including said first and second connector dimensions, said second connector dimension being greater than a diameter of said circular cross-sectional configuration of said first portion to prevent said writing instrument from rolling.

13. The writing instrument of claim 12 wherein said eraser has a substantially constant cross-sectional configuration in any plane perpendicular to said longitudinal axis.

* * * * *